US005944549A

United States Patent [19]

Po et al.

[11] Patent Number: 5,944,549

[45] Date of Patent: Aug. 31, 1999

[54] ELECTRICAL CONNECTOR HAVING LATCH DEVICES

[75] Inventors: Li-Ming Po; Yu-San Hsiao, both of Tu-Chen, Taiwan

[73] Assignee: Hon Hai Precision Ind. Co., Ltd., Taipei Hsien, Taiwan

[21] Appl. No.: 08/917,638

[22] Filed: Aug. 22, 1997

[51] Int. Cl.[6] ..... H01R 13/62

[52] U.S. Cl. ..... 439/326

[58] Field of Search ..... 439/325–329, 439/341–342, 358, 629, 630

[56] References Cited

U.S. PATENT DOCUMENTS 5,002,498 3/1991 Takahashi ..... 439/326
5,267,872 12/1993 Gou et al. ..... 439/326
5,769,668 6/1998 Tondreault ..... 439/633

*Primary Examiner*—Kheim Nguyen

[57] ABSTRACT

An electrical connector having latch devices is disclosed. The electrical connector comprises an elongated insulating housing defining an elongate, narrow slot for receiving a circuit board, a plurality of conductive contacts received in a plurality of passageways defined along inner surfaces of the circuit board receiving slot for electrical and mechanical connecting the circuit board, and latch devices integrally extending upward from both lateral ends of the insulating housing. Each of the latch devices includes a forward protruding positioning lug for guiding and positioning the insertion of the circuit board into the slot, an inward protruding latching lug for latching the circuit board received in the slot, and a releasing portion for releasing the latching of the latching lug to the circuit board.

16 Claims, 4 Drawing Sheets

ELECTRICAL CONNECTOR HAVING LATCH DEVICES

BACKGROUND OF THE INVENTION

1. Field of The Invention

The invention relates to an electrical connector having latch devices, particularly to a Single In-line Memory Module (SIMM) connector.

2. The Prior Art

Conventional SIMM connectors were proposed in, for example, Taiwan Patent Application Nos. 80209187, 81105536, 81200669, 81202308, 84101281 and 84207744, and U.S. Pat. Ser. Nos. 4057879, 4772700, 4985754, 7094624, 5286217 and 53383792. A typical one of such SIMM connectors is shown in FIG. 1 and designated 1, generally comprising an elongated insulating housing, a plurality of conductive contacts received in the housing, and latch devices 2 for latching an electrical device such as a PCB (printed circuit board) 4 received therein. Each of the latch devices 2 of the connector 1 comprises a post having a latching lug 24, a releasing lever 22 at substantially the same level as the latching lug 24 and a positioning protrusion 31, and a backstop 11 integrally extending vertically from the post at an outward side thereof.

The above-mentioned latch device, however, has the defect that a metal part of the latch device is liable to touch a circuit of the PCB 4 since the latching lug is not formed high enough to avoid the circuit, which results in short circuit or mechanical damage of the PCB 4. In addition, a relatively large bending moment occurs on a root portion of the backstop 11 while pulling outward the releasing lever 22 to release the PCB 4 received therein since the arm length of the backstop 11 is relatively long, which usually causes breakdown of the backstop 11. Furthermore, the positioning protrusion 31 of the latch device 2 is not well guided into a positioning hole 41 of the PCB 4 while the PCB 4 is inserted into the connector, which makes it difficult to properly situate the PCB 4 in place.

Hence, there is a need for an electrical connector having latch devices that can overcome the above-mentioned defects.

SUMMARY OF THE INVENTION

Accordingly, one object of the present invention is to provide an electrical connector having latch devices which will not damage the circuit board received therein.

Another object of the present invention is to provide an electrical connector having latch devices which include stopper means providing excellent stopping effect.

One more object of the present invention is to provide an electrical connector having latch devices which include guiding means for insertion of a circuit board.

To fulfill the above-mentioned objects, according to one embodiment of the present invention, the electrical connector comprises an elongated insulating housing defining an elongate, narrow slot for receiving a circuit board, a plurality of conductive contacts received in a plurality of passageways defined along inner surfaces of the circuit board receiving slot for electrical and mechanical connecting the circuit board, and latch devices integrally extending upward from both lengthwise ends of the insulating housing. Each of the latch devices includes a forward protruding positioning lug for guiding and positioning the insertion of the circuit board into the slot, an inward protruding latching lug for latching the circuit board received in the slot, and a releasing portion for releasing the latching of the latching lug to the circuit board.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 1:
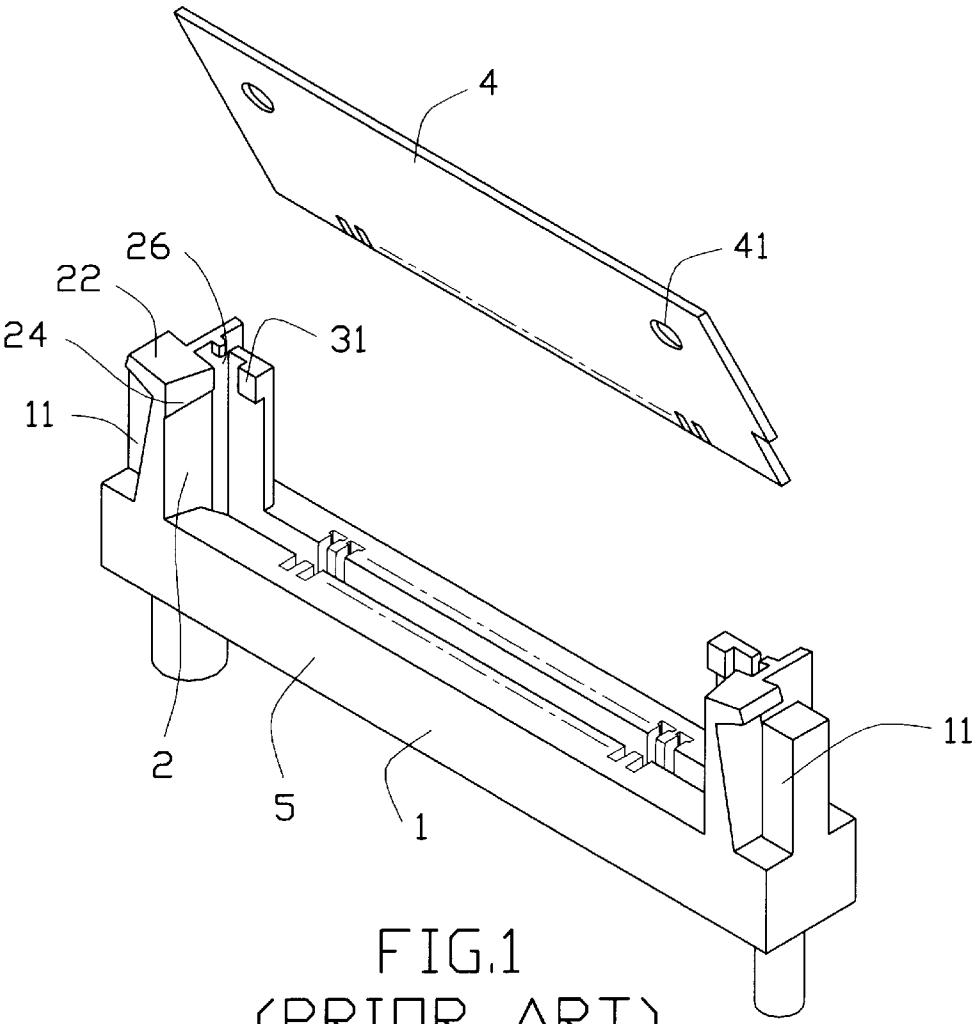
FIG.1 (PRIOR ART)
FIG. 1 is a perspective view of an electrical connector having conventional latch devices.

Reference will now be made in detail to the preferred embodiments of the present invention. It will be noted here that for a better understanding, most of like components are designated by like reference numerals throughout the various figures in the embodiments.

Figure 2:
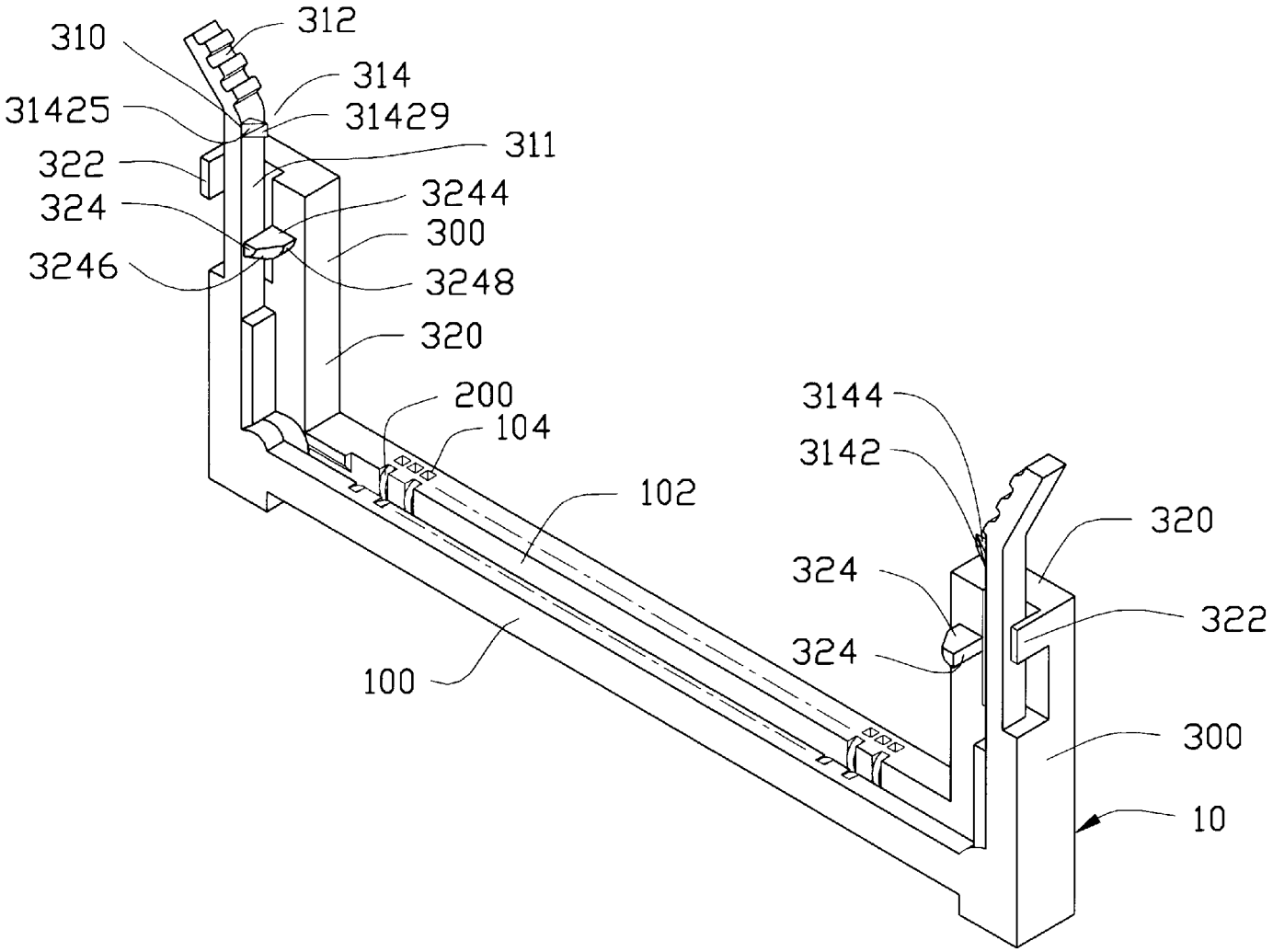
FIG. 2 is a perspective view of an electrical connector having latch devices according to one preferred embodiment of the present invention.
Figure 3A:
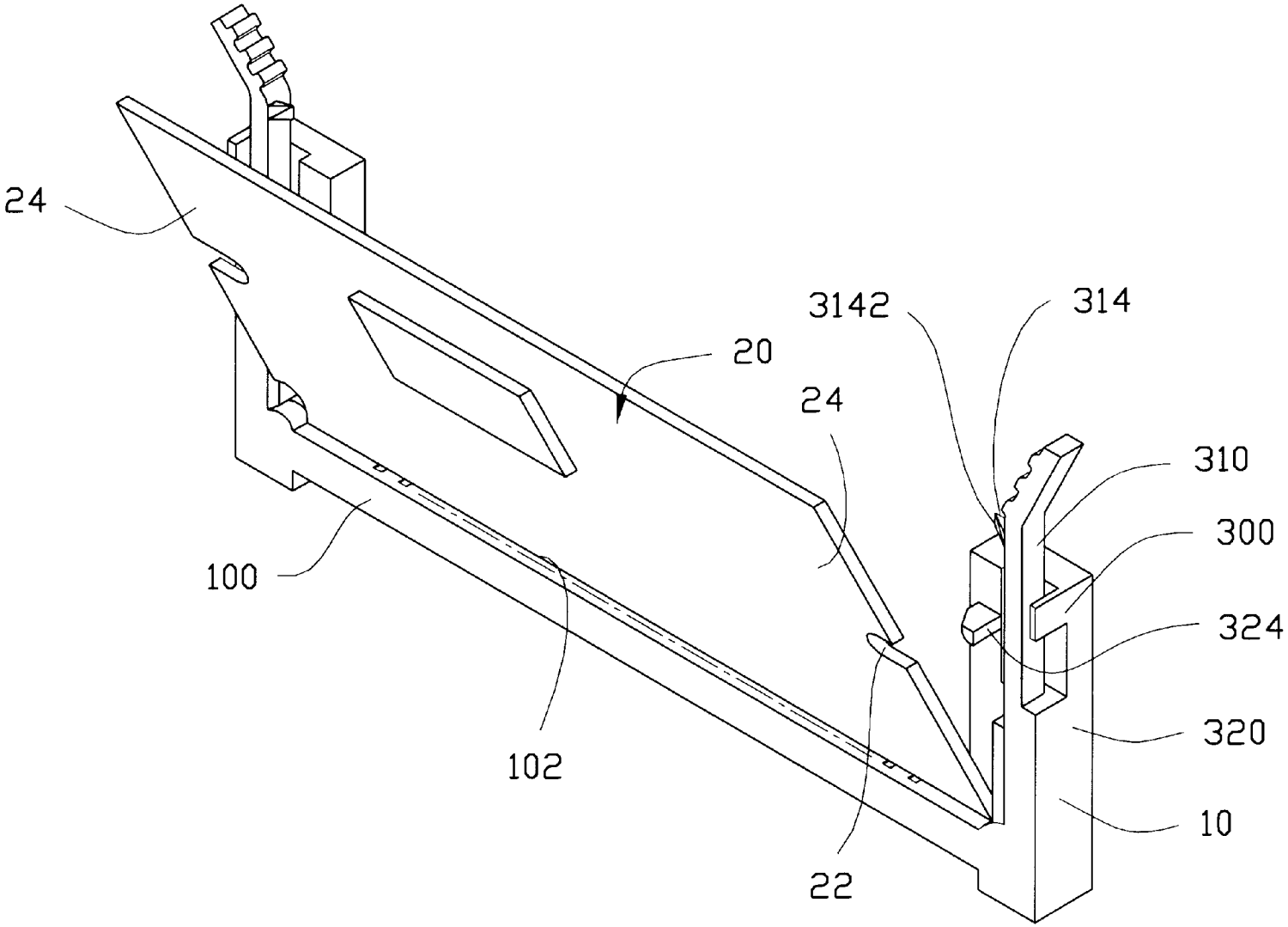
FIG. 3A shows mounting of a PCB onto the electrical connector shown in FIG. 2.
Figure 3B:
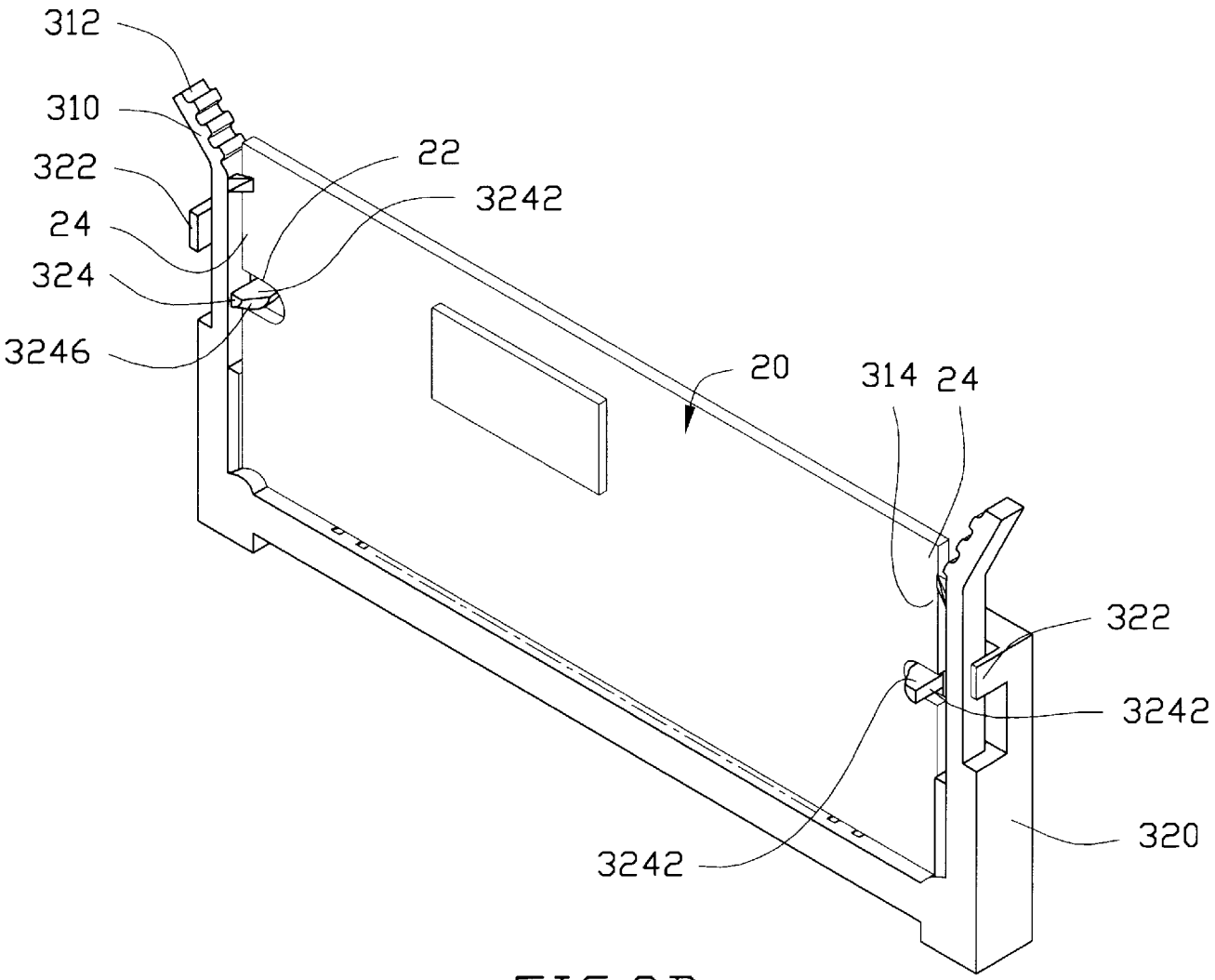
FIG. 3B shows completion of the mounting of the electrical connector with the PCB of FIG. 3A.

Referring to FIG. 2, an electrical connector having latch devices according to the present invention for connecting between a mother board (not shown) to which the connector is mounted and a daughter board 20 (as shown in FIGS. 3A and 3B) is generally designated 10. The electrical connector 10 mainly comprises an elongate insulating housing 100, a plurality of conductive contacts 200, and latch devices 300. The elongate housing 100 defines an elongate, narrow slot 102 for receiving the daughter board 20. The slot 102 defines two rows of passageways 104 along both inner surfaces thereof for receiving the contacts 200. Each latch device 300 is provided on a corresponding lengthwise end of the housing 100 and comprises a higher first post 310 and a shorter second post 320.

The first post 310 includes a resilient arm 311 integrally formed on a front portion of the lengthwise end of the housing 100 and an upper releasing portion 312 integrally extending upward and outward from the resilient arm 311. Each of the resilient arms 311 comprises an inward protruding latching lug 314 at a relatively high level for latching the daughter board 20 received in the slot 102 at an upper position thereof. Since the latching lugs 314 engage the daughter board 20 at the upper positions on which no circuit layout is printed, the daughter board 20 will not be damaged by the latching lugs 314. The latching lug 314 defines an upper horizontal surface 3144 and a front surface 3142 including two oblique triangular faces. The two oblique triangular faces comprise an upper oblique face 31425 facing obliquely inward, and a lower oblique face 31429 facing obliquely inward and downward. The releasing portions 312 extend outward slightly and have racks on their surfaces to facilitate holding.

The second post 320 is provided adjacent to the first post 310 and includes a forward protruding positioning lug 324 for positioning the insertion of the daughter board 20. The positioning lug 324 defines an upper horizontal surface 3244, an outward vertical surface 3245, a cylindrical surface 3248 adjacent to a front surface of the second post 320, and a conical surface 3246 extending from the cylindrical surface 3248. Both the cylindrical surface 3248 and the conical surface 3246 face inward and downward. Each of the second posts 320 also includes a backstop 322 integrally extending horizontally therefrom to an outward location of the first post 310 at a level lower than that of the latching lug 314. The backstop 322 is formed as a cantilever beam to provide stopping and supporting effects to the first post 310.

When the daughter board 20 has just been inserted into the connector 10 from a front side thereof, as shown in FIG. 3A, a lower edge of the daughter board 20 first abuts an inner wall of the slot 102 but does not completely received in the slot 102, with the whole board body inclining forward and a pair of positioning notches 22 of the daughter board 20 aligning the positioning lugs 324 of the second posts 320. Next, the positioning notches 22 of the daughter board 20 are first guided by the front conical surface 3246 and then slip forward along the cylindrical surfaces 3248 of the positioning lugs 324 when the daughter board 20 pivots around its lower edge and slips gradually into the slot 102. Meanwhile, a pair of upper lateral edges 24 of the daughter board 20 are first abutting the front surfaces 3142 of the latching lugs 314 and then slipping over the latching lugs 314 with the help of both the outward movement of the arms 311 of the first posts 310 due to resilience thereof and the two oblique triangular faces 31425, 31429 of the front surfaces 3142 of the latching lugs 314. Finally, the arms 311 resile back to their vertical positions as before the insertion of the daughter board 20 and the daughter board 20 is completely inserted into the connector 10. Consequently, the vertical and lateral movements of the daughter board 20 relative to the connector 10 are restrained by the positioning lugs 324 and the forward movement of the daughter board 20 relative to the connector 10 is restrained by the latching lugs 314. The daughter 20 is thus firmly retained in the connector 10.

When the daughter board 20 is removed from the connector 10, the releasing portions 312 of the first posts 310 are manually pulled outward so that the latching lugs 314 no more latch the daughter board 20 at its upper lateral edges 24 and that the daughter board 20 can be removed from the front side of the connector 10. When the releasing portions 312 are pulled outward, the outward movement of each of the first posts 310 will be stopped by the corresponding backstop 322. Since the arm length of the backstop 322 is relatively short, a relatively small torque occurs on a root of the backstop 322, which results in a relatively strong backstop 322 and lowers the possibility of breakdown failure of the connector 10 and thus provides an excellent stopping effect to the first post 310.

Although in the above preferred embodiment of the present invention, the positioning lugs 324 are formed on the second posts 320, they can also be formed on the first posts 310 rather than the second posts 320. In this case, the first posts 310 includes both the latching lugs and the positioning lugs, while the second posts 320 merely include the backstops 322. In a further embodiment in which the resilient arms 311 of the first posts 310 are made strong enough to sustain outward pulling forces, the second posts 320 can be omitted to simplify the structure of the connector 10.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. An electrical connector, comprising: an elongated insulating housing defining an elongate, narrow slot for receiving a circuit board;

a plurality of conductive contacts received in a plurality of passageways defined along inner surfaces of the circuit board receiving slot for electrical and mechanical connection to the circuit board; and a pair of latch devices each integrally extending upward from both lengthwise ends of the insulating housing, each of said latch devices including a first post and a second post, the first post comprising:

an inward protruding latching lug for latching the circuit board received in the slot; and a releasing portion for releasing the latching of the latching lug to the circuit board; and the second post comprising:

a forward protruding positioning lug for guiding and positioning the insertion of the circuit board into the slot; and a backstop for stopping an outward over-deformation of the first post while the first post is being pulling outward; wherein, said first post is substantially higher than said second post and said latching lug is positioned at a substantially higher level than said positioning lug to retain the circuit board in a stable position.

2. The electrical connector as claimed in claim 1, wherein the first post comprises a resilient arm with said latching lug and said releasing portion integrally formed on said resilient arm.

3. The electrical connector as claimed in claim 2, wherein the backstop integrally extends horizontally from the second post to an outward location of the first post.

4. The electrical connector as claimed in claim 3, wherein said backstop is as a cantilever beam.

5. The electrical connector as claimed in claim 3, wherein said second post with said backstop together form a U-shaped structure partially surrounding said first post.

6. The electrical connector as claimed in claim 3, wherein said latching lug is formed on a position higher than that of the backstop.

7. The electrical connector as claimed in claim 1, wherein said latching lug defines a front surface including at least one oblique triangular face for facilitating the insertion of the circuit into the slot.

8. The electrical connector as claimed in claim 7, wherein said at least one oblique triangular face includes an upper oblique face facing obliquely inward and a lower oblique face facing obliquely inward and downward.

9. The electrical connector as claimed in claim 1, wherein said positioning lug defines a cylindrical surface adjacent to a front surface of the second post and a conical surface extending from the cylindrical surface, said conical surface extending facing inward and downward for guiding the insertion of the circuit board into the slot and said cylindrical surface facing inward and downward for positioning the circuit board received in the slot.

10. The electrical connector as claimed in claim 1, wherein each of said latch devices comprises a post including a resilient arm with said positioning lug, said latching lug, and said releasing portion integrally formed on said resilient arm.

11. The electrical connector as claimed in claim 10, wherein said positioning lug is formed on a lower position of the post than said latching lug.

12. An arrangement of an electrical connector and a circuit board having a pair of notches on both lateral edges, said electrical connector comprising:

an elongated insulating housing defining an elongate, narrow slot for receiving the circuit board;

a plurality of conductive contacts received in a plurality of passageways defined along inner surfaces of the circuit board receiving slot for electrical and mechanical connection to the circuit board; and a pair of latch devices each integrally extending upward from both lengthwise ends of the insulating housing, each of said latch devices including a first post and a second post, the first post comprising:

an inward protruding latching lug for latching the circuit board received in the slot; and a releasing portion for releasing the latching of the latching lug to the circuit board; and the second post comprising:

a forward protruding positioning lug for guiding and positioning the insertion of the circuit board into the slot; and a backstop for stopping an outward over-deformation of the first post while the first post is being pulling outward; wherein, said first post is substantially higher than said second post and said latching lug is positioned at a substantially higher level than said positioning lug to retain the circuit board in a stable position.

13. The arrangement as claimed in claim 12, wherein said latching lug engages the electrical circuit at an upper position thereof on which no circuit layout is printed.

14. The arrangement as claimed in claim 12, wherein said latching lug engages the electrical circuit at an upper position adjacent to an upper edge of the electrical circuit.

15. The arrangement as claimed in claim 12, wherein the pair of notches of said circuit board are substantially semi-circular notches.

16. A combination of an electrical connector with a circuit board wherein said circuit board includes a pair of notches on mid-lower portions of two lateral edges, respectively;

said connector including an insulating housing defining a slot for receiving the circuit board therein;

at least one latch device positioned at a lengthwise end of the housing, each latch device comprising a first post and a second post, the first post comprising:

a forward protruding positioning lug located on a fixed portion of said latch device with regard to the housing; and the second post comprising:

an inward protruding latching lug located on a resilient portion of said latch device with regard to the housing; wherein said forward protruding positioning lug is situated at a height below a top face of the second post for being adapted to be received within one corresponding notch of the circuit board and the inward protruding latching lug is situated at a height above the top face of the second post and is far away from the slot and substantially closer to a top edge of the circuit board for being adapted to abut against an upper portion of one of said lateral edges.

* * * * *